US005380948A

United States Patent [19]

Freimuth et al.

[11] Patent Number: 5,380,948

[45] Date of Patent: Jan. 10, 1995

[54] MUSICAL STRINGED INSTRUMENT CAPABLE OF BEING PLAYED WITH ONE HAND

[76] Inventors: Arthur Freimuth; Stanley Freimuth, both of 25 W. Southern, Covington, Ky. 41015

[21] Appl. No.: 895,775

[22] Filed: Jun. 9, 1992

[51] Int. Cl.[6] ..... G10F 1/20

[52] U.S. Cl. ..... 84/8; 84/320; 84/DIG. 30

[58] Field of Search ..... 84/12, 7, 646, 653, 84/670, 726, 742, 743, DIG. 7, DIG. 30, 7-12, 746, 8, 320

[56] References Cited

U.S. PATENT DOCUMENTS

| | | | |
|---|---|---|---|
| 4,024,787 | 5/1977 | Larson | 84/743 |
| 4,037,503 | 7/1977 | Jacobson et al. | 84/9 |
| 4,142,961 | 9/1992 | Paroutaud | 84/726 |
| 5,121,668 | 6/1992 | Segan et al. | 84/646 |
| 5,140,887 | 8/1992 | Chapman | 84/DIG. 7 |
| 5,153,364 | 10/1992 | Uchiyama et al. | 84/742 |
| 5,162,603 | 11/1992 | Bunker | 84/737 |

*Primary Examiner*—Jonathan Wysocki
*Assistant Examiner*—Jeffrey W. Donels

[57] ABSTRACT

A musical stringed instrument including a control circuit that provides a means for playing with one hand. The control circuit is either integral with or external to the musical stringed instrument. One hand operation is accomplished by selectively bringing one or more of the strings into electrical contact with any one or more electrical contacts or frets or by depressing any one or more switches corresponding to each string. A striker pad impacts the chosen string causing it to vibrate. Variation in the notes is accomplished in a manner consistent with two handed operation of the musical stringed instrument.

9 Claims, 5 Drawing Sheets

28
G1
30
J4
H1
34
H3
J2
J3
32
96
28
J1
10
26
40

MUSICAL STRINGED INSTRUMENT CAPABLE OF BEING PLAYED WITH ONE HAND

BACKGROUND OF THE INVENTION

1. Field of the Invention

This invention relates, in general, to musical stringed instruments and more particularly to electrical guitars and the like that include a control circuit that permits playing with one hand.

2. Description of the Prior Art

Conventional stringed instruments, such as guitars and banjos, require the use of two hands to operate. A first hand causes one or more strings to come into contact with a fret to change its effective length thereby changing the sound pitch created when a second hand causes one or more strings to vibrate. Difficulty arises when an operator has only one functioning hand or desires to use one of their hands to perform other tasks while playing a musical stringed instrument, such as the playing of more than one instrument at the same time.

Attempts have been made to permit an operator to play a musical stringed instrument with one hand by providing a means to simultaneously vibrate one or more chosen strings and change their effective length with one hand. Other inventions that enable a player to operate a musical stringed instrument with one hand require either the use of one's foot to provide the function of the second hand or a means to turn the electronic pickups either on or off for individual strings.

The present invention enables a player to operate a musical stringed instrument with one hand only and does not require any other external input and can be used on musical stringed instruments that do not have electronic pickups. Further, the present invention is simple to install and less costly than other attempts to create a musical stringed instrument capable of being played with one hand.

SUMMARY OF THE INVENTION

In carrying out this invention, in one form thereof, a musical stringed instrument is provided which includes an instrument body having a fret board. The fret board includes a plurality of electrically common and electrically conductive frets spaced along the fret board. One or more electrically isolated and electrically conductive vibratory strings are connected to the instrument body in laterally spaced relationship and are held in tension over and in close proximity to the plurality of frets. An identifying means generates a string signal when any one or more of said strings have been placed in electrical contact with any one or more of said frets or when an electrical switch corresponding to each of the strings is operated. A means for striking each of the strings responds to the string signal by causing each respective string to be struck, thereby vibrating the string. In one form of the invention, the identifying means is an electrical circuit that includes a schmitt trigger, a monostable multivibrator and a solid state relay and generates the string signal and includes an electromagnetic solenoid connected to a rocker arm that strikes each string. In another modified form of the invention, the operator can cutoff lower string operation by triggering a predetermined combination of solenoids. A multiple input handgate could be used to predetermine the combination that would prevent one or more of the lower strings from being operated or cutoff as it is referred to here.

BRIEF DESCRIPTION OF THE DRAWINGS

A more complete understanding of the invention may be had by reference to the accompanying drawings in which.

DESCRIPTION OF THE PREFERRED EMBODIMENTS

Figure 1:
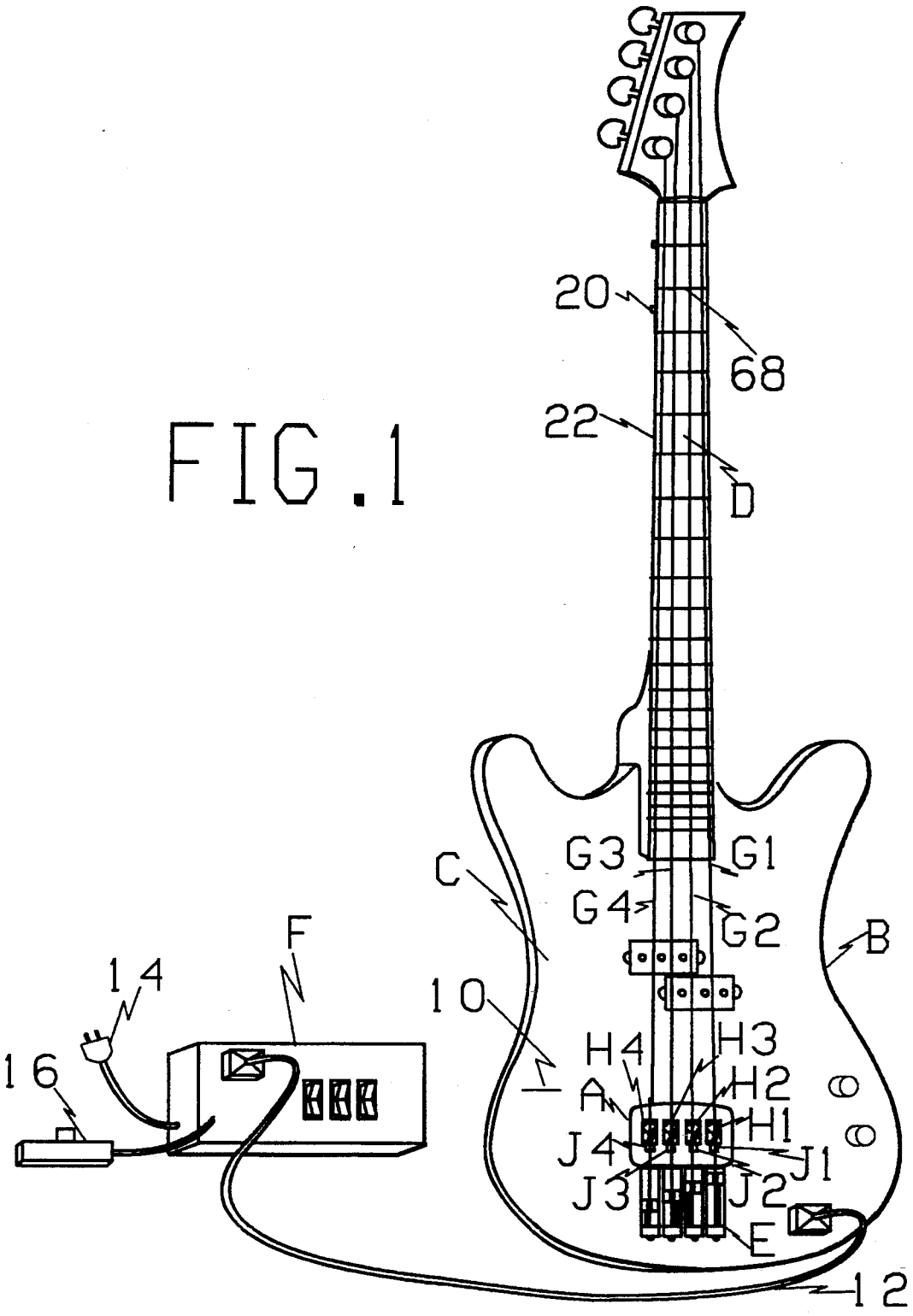
FIG. 1 is a perspective view of a guitar according to the present invention showing the position of the solenoids, the fret board, the strings and the guitar body.

Referring now to the Figures where like reference numerals have been used throughout to designate like parts, FIG. 1 shows an electrical guitar B of conventional design with the present invention A installed thereon. The guitar B comprises a fret board D connected to and extending outwardly from a body C. Strings G1 to G4 extend along and are connected to fret board D and are connected to first side 10 of body C through bridge E. The installation of the present invention A is illustrated in FIG. 1 and shows striker pads H1 to H4 located in close proximity to strings G1 to G4 respectively. Rocker arm relays J1 to J4 are connected to and operate striker pads H1 to H4 respectively. When any one or more of strings G1 to G4 are depressed and brought into electrical contact with any one or more of frets 68, a string signal is generated corresponding to the depressed string. The string signal activates the corresponding rocker arm relay J1 to J4 causing striker pads H1 to H4 to impact upon strings G1 to G4 respectively, thereby causing strings G1 to G4 to vibrate. Outboard control circuit F is connected to and powers rocker arm relays J1 to J4 through interface cable 12. Outboard control circuit F is connected to conventionally available electrical power through power cable 14. Outboard control circuit F can be turned off or on by manipulation of foot switch 16. Thumb buttons 20 are mounted on top side 22 of fret board D and are described in FIG. 5.

Figure 2:
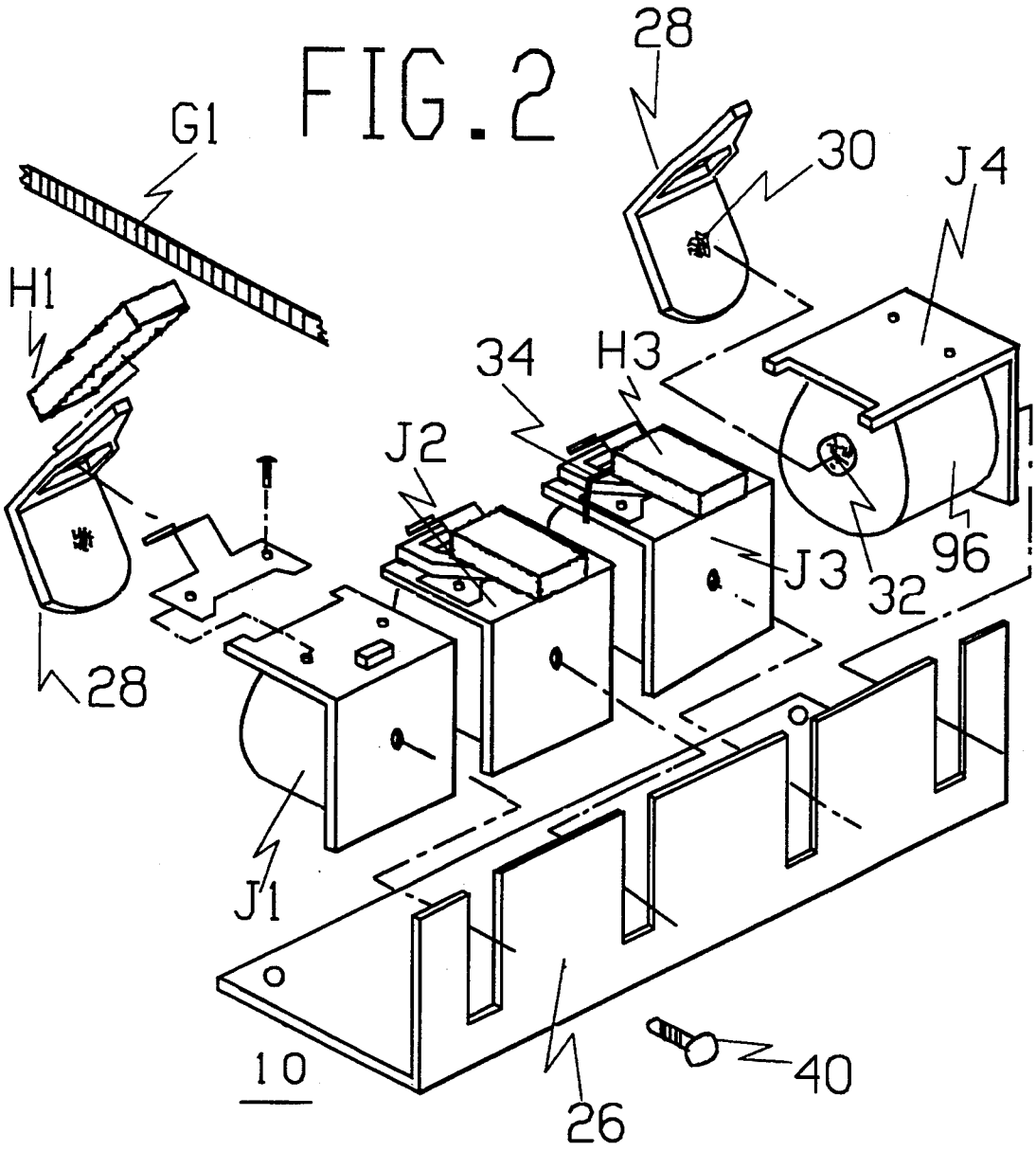
FIG. 2 illustrates the details of the solenoid and rocker arm and their position in relation to the string for an upward strike of the string.

FIG. 2 shows an exploded view of rocker arm relays J1 to J4, mounting bracket 26 and striker pad H1. Mounting bracket 26 is secured to first side 10 of guitar body C. Rocker arm relays J1 to J4 are mounted to mounting bracket 26 by screws 40. Rocker arm relays J1 to J4 are identical and are shown in various stages of disassembly and comprise rocker arm 28, coil 96 and coil core 32. Coil 96 comprises a plurality of turns of wire and coil core 32 is comprised of magnetic material and is of conventional design. Rocker arm 28 is pivotally connected to rocker arm J4. Rocker arm 28 pivots to make contact with coil core 32 at point 30 where a thin layer of damping material is located. Referring now to rocker arm relay J1, striker pad H1 is connected to rocker arm 28 and upon activation of rocker arm relay J1 in response to a string signal, striker pad H1 will impact string G1 and cause string G1 to vibrate. Elastic material 34 .acts as a return spring for rocker arm 28 and can be made of rubber or spring wire.

Figure 3:
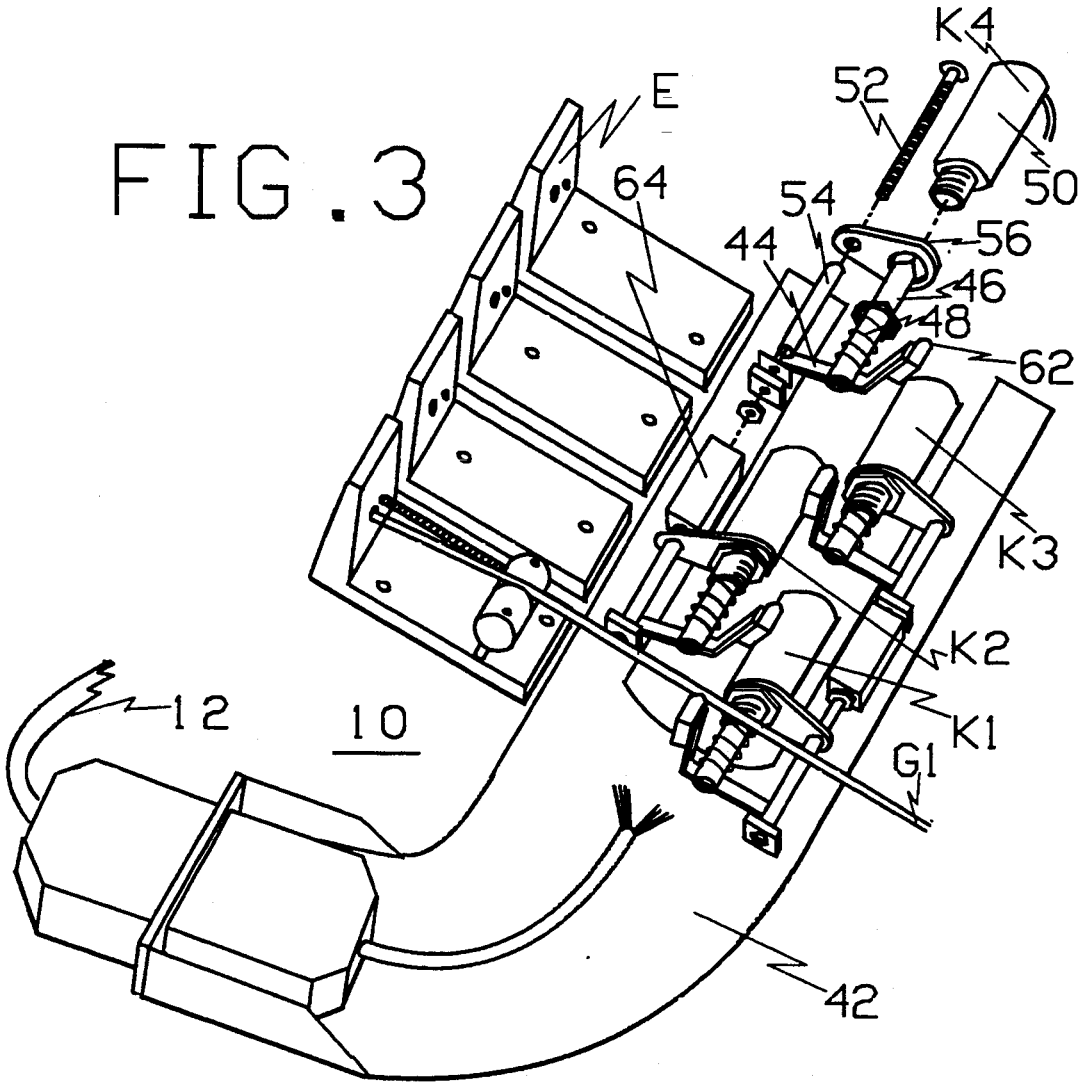
FIG. 3 illustrates the details of the solenoid and rocker arm and their position in relation to the string for a lateral strike of the string.

FIG. 3 illustrates an alternate means for striking strings G1 to G4. Alternate solenoids K1 to K4 are used when a lateral strike of the strings is needed such as when modifications to an existing musical stringed instrument is not practical or desired. In FIG. 3, alternate solenoids K1 to K4 are identical and K4 is illustrated in an exploded view. Solenoid K4 comprises solenoid body 50, actuator 46, coil spring 48, striker arm 44 and striker pad 62. Solenoid body 50 is attached to mounting bracket 42 through spacer 54, mounting bracket 56 and mounting block 64 by machine screw 52 and is positioned adjacent string G4 (not shown). Striker arm 44 is attached perpendicular to actuator 46. Striker pad 62 is attached to a first end of striker arm 44 and a second end of striker arm 44 is located under spacer 54 upon assembly and is free to slide thereunder. Machine screw 52 is adjusted to position striker pad 62 next to but not touching string G4 (not shown). Upon activation of solenoid K4 in response to a string signal, actuator 46 is pulled into solenoid body 50 causing striker pad 62 to impact string G4 (not shown). Coil spring 48 returns striker arm 44 to its starting position.

Figure 4:
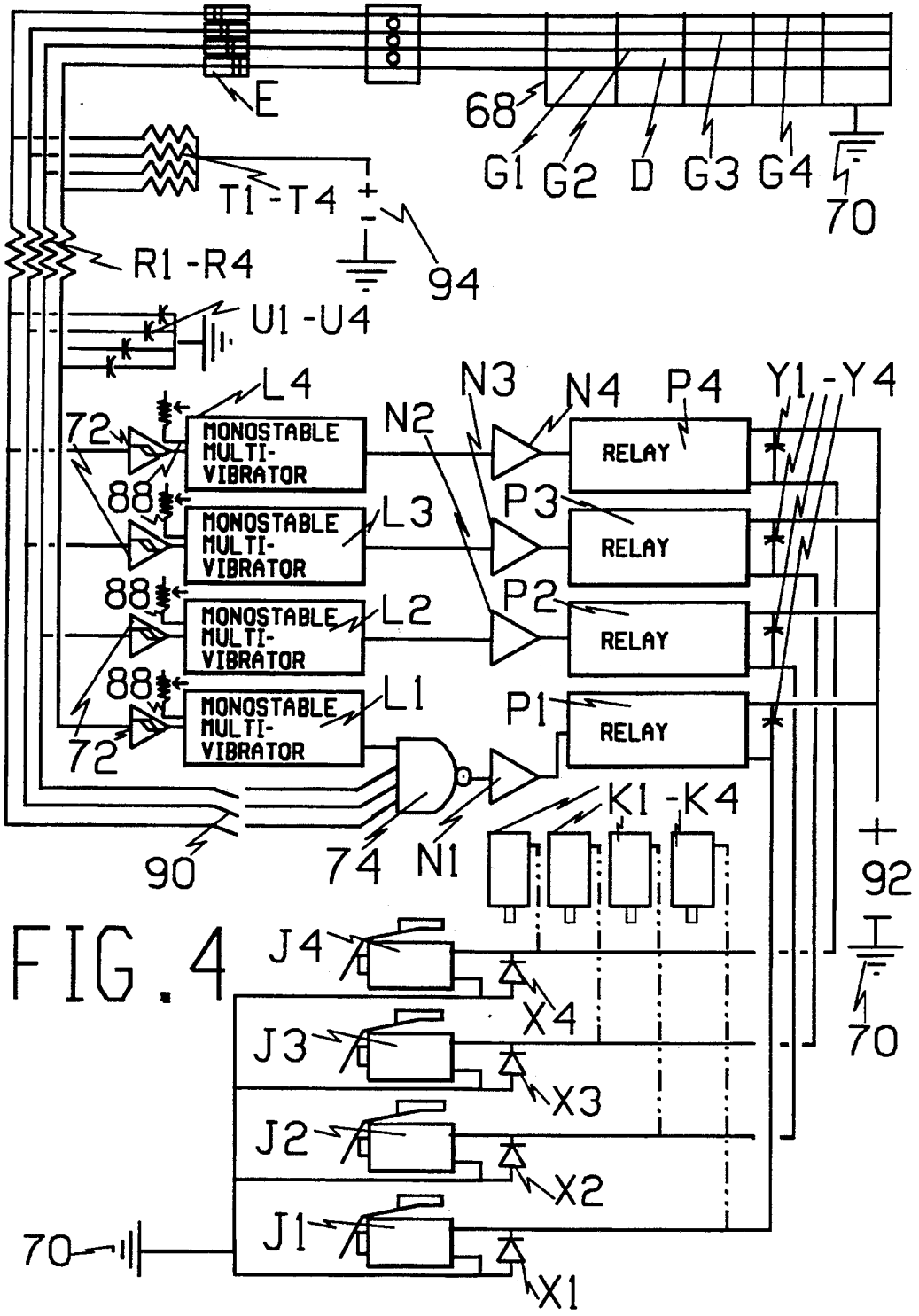
FIG. 4 illustrates a simplified circuit diagram, partly in block form, of the control system of thee present invention.

FIG. 4 illustrates the electrical control circuit F of the present invention. Fret board D comprises a plurality of electrically conductive frets 68 spaced along its length and a plurality of strings G1 to G4 spaced in lateral relationship along fret board D and perpendicular to and in close proximity to frets 68. Frets 68 are electrically common and are held at ground potential 70. A string signal for strings G1 to G4 is generated when any one or more of strings G1 to G4 is brought into electrical contact with any one or more of frets 68. Response to string signals from strings G2 to G4 is identical and the response for one string signal is described herein with the intent to describe the response to the string signal for each string G2 to G4. Response to a string signal from string G1 is slightly different as is described below. Strings (G1 to G4 are electrically energized by separate power supply 94 through resistors T1 to T4. Strings G1 to G4 are each connected to separate schmitt triggers 72 and to multiple input nandgate 74 through signal shaping resistors R1 to R4 and capacitors U1 to U4. A string signal from strings G1 to G4 initiate schmitt triggers 72 which drive monostable multivibrators L1 to L4, or one shots as they are sometimes referred to in the industry. Monostable multivibrators L1 to L4 generate one pulse with a constant pulse width, Potentiometers 88 control the pulse width of each monostable multivibrator L1 to L4 and is adjustable. Output Q of monostable multivibrators L2 to L4 are connected to the input of buffer/drivers N2 to N4 respectively. Output "Q not" of monostable multivibrator L1 is connected to one of the inputs of multiple input nandgate 74. String signals from other strings G2 to G4 enter multiple input nandgate 74 through signal shaping resistors R1 to R4 and capacitors U1 to U4. The output of multiple input nandgate 74 is connected to the input of buffer/driver N1. The output of buffer/drivers N1 to N4 energize solid state relays P1 to P4 that drive rocker arm solenoids J1 to J4 or alternatively solenoids K1 to K4. The function of multiple input nandgate 74 is to deactivate string G1 when strings G2 to G4 are simultaneously in electrical contact with any one or more of frets 68. Diodes X1 to X4 are connected between the input of each solenoid and ground 70 and capacitors Y1 to Y4 are connected between the output of each solid state relay P1 to P4 and power supply 92, respectively, to suppress electrical noise. Power supply 92 provides the energy for solid state relays P1 to P4 and rocker arm relays J1 to J4, or alternatively for solenoids K1 to K4.

Figure 5:
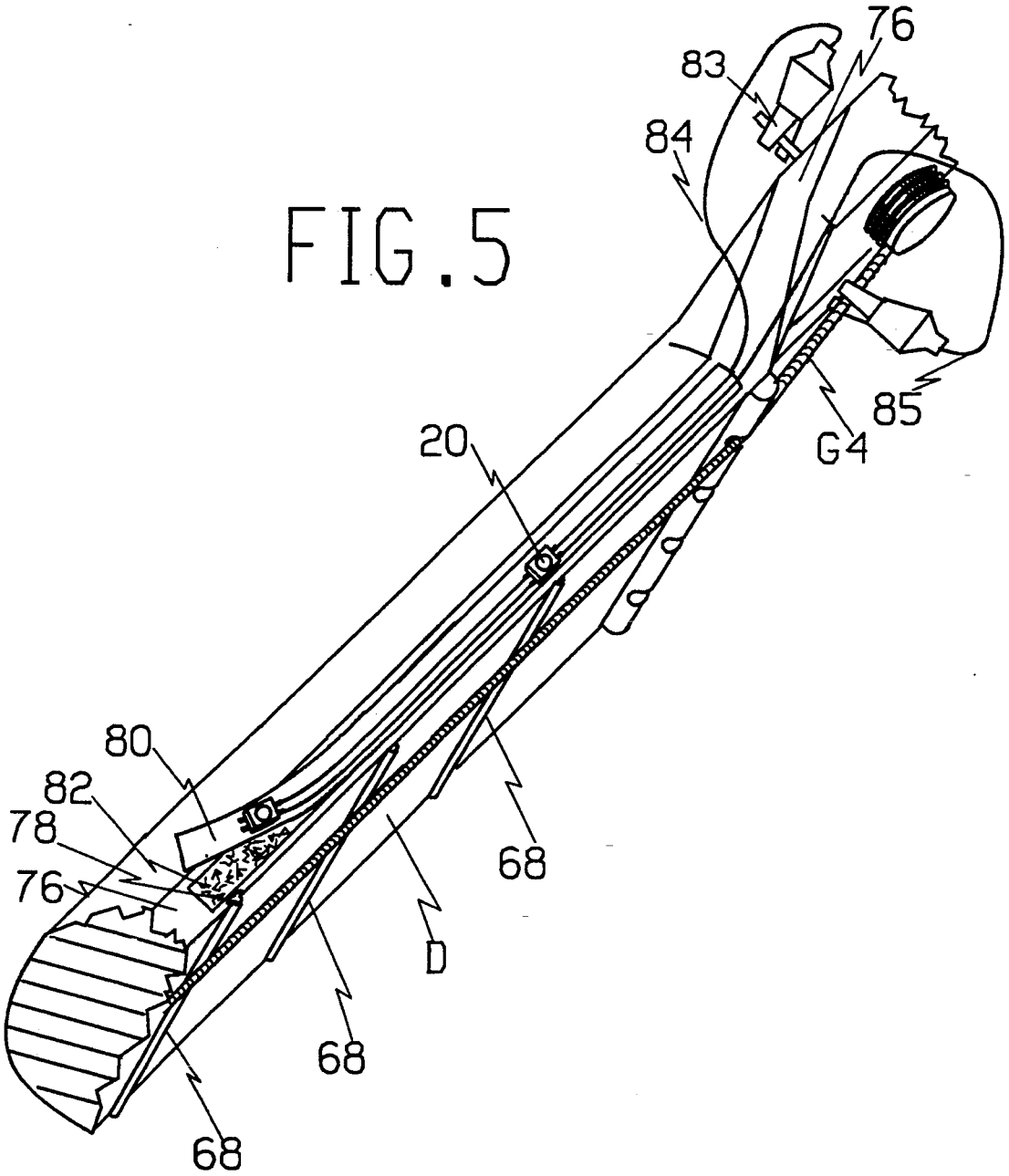
FIG. 5 is a perspective view of the electrical switch used to trigger an open string.

FIG. 5 illustrates a section of fret board D with thumb buttons 20. Frets 68 are laterally spaced perpendicular to and along fret board D and are electrically common. Copper tape, 76 or other conductive material extends along the length of fret board D and is electrically connected to each fret 68 by solder joint 78 or other suitable means. Thumb buttons 20 are provided for each string G1 to G4 and are attached to fret board D with hook and loop tape or other suitable means. Wire 84 illustrates a functional electrical connection between one thumb button 20 and electrical output connection 83. Wire 85 illustrates a functional electrical connection between one thumb button 20 and string G4. Thumb buttons 20 are electrically connected in similar fashion between each string G1 to G4 and multiple input nandgate 74 as illustrated in FIG. 4. Thumb buttons 20 are electrical switches 90 that when depressed generate a string signal that causes each respective string to be impacted by striker pad H1 to H4 as illustrated of FIGS. 4, 3 and 2.

In the specific embodiment illustrated in FIGS. 1 through 5, a musical stringed instrument can be operated with one hand. An operator creates a note when a string signal is created which causes striker pad 62 to impact the desired string. A string signal is generated by either depressing a desired string G1 to G4 in such a manner that it comes into electrical contact with any one or more frets 68 or by depressing a thumb button 20 corresponding to a desired open string G1 to G4. When all strings are selected at the same time, string G1 is prevented from being struck by the function of multiple input nandgate 74. It should be understood that other arrangements for deselecting a given one or more strings is contemplated by the inventor herein and the deselecting of string G1 is simply an illustration of the scope of the control option anticipated herein. Thumb buttons 20 can also function to generate multiple impact on a given string G1 to G4 by depressing it more than once whether string G1 to G4 is in electrical contact with frets 68 or is open.

The invention described herein provides a reliable, simple, safe and easy method for playing a musical stringed instrument, such as an electrical guitar, with one hand. It is intended that the description should not act as a limitation on the scope of the invention disclosed, but rather is an exemplification of one embodiment thereof. Many other embodiments and variations are anticipated such as use on an acoustic guitar, variations in the control circuitry and use with more or less than four (4) strings. The scope of the invention should be limited only be the appended claims and not by the examples given.

We claim:

1. A musical stringed instrument comprising:

a) an instrument body having a fretboard;

b) a plurality of electrically common and electrically conductive frets spaced along said fretboard;

c) one or more electrically isolated and electrically conductive vibratory strings connected to said instrument body in laterally spaced relationship and held in tension over and in close proximity to said plurality of said frets;

d) an identifying means that generates a string signal when any one or more of said strings have been placed in electrical contact with any one or more of said frets or when an electrical switch corresponding to each of said strings is operated;

e) a striking means for each of said strings that is responsive to said string signal.

2. A musical stringed instrument as described in claim 1, wherein said identifying means comprises an electrical circuit that includes a schmitt trigger, a monostable multivibrator and a solid state relay.

3. A musical stringed instrument as described in claim 1, wherein said striking means comprises an electromagnetic solenoid.

4. A musical stringed instrument comprising:

a) an instrument body having a fretboard;

b) a plurality of electrically common and electrically conductive frets spaced along said fretboard;

c) one or more electrically isolated and electrically conductive vibratory strings connected to said instrument body in laterally spaced relationship and held in tension over and in close proximity to said plurality of frets;

d) an electrical circuit that generates a string signal for each of said strings;

f) an electromagnetic solenoid that responds to said signal by striking any one or more of said strings.

5. A musical stringed instrument as described in claim 4, wherein said string signal for each of said strings is generated when any one or more of said strings is placed in electrical contact with any one or more of said frets or when an electrical switch corresponding to each of said strings is operated.

6. A musical stringed instrument as described in claim 5, wherein said electrical circuit includes a schmitt trigger, a monostable multivibrator and a solid state relay.

7. A musical stringed instrument as described in claim 6, wherein said schmitt trigger, monostable multivibrator and solid state relay generate said string signal.

8. A musical stringed instrument as described in claim 7, including means to cutoff lower string operation when a predetermined combination of solenoids have been triggered.

9. A musical stringed instrument as described in claim 8, wherein said cutoff means comprises a multiple input nandgate.

* * * * *